US005779463A

United States Patent [19]

Rossel et al.

[11] Patent Number: 5,779,463

[45] Date of Patent: Jul. 14, 1998

[54] ROTARY PISTON PUMP HAVING A SLIDE VALVE DRIVEN BY A ROTOR

[75] Inventors: Helmut Rossel, Neuss; Martin Krucinski, Krefeld; Rainer Strauss, Monchen-Gladbach; Ulrich Flesch, Essen; Dieter Jelinek, Dusseldorf, all of Germany

[73] Assignee: Pierburg AG, Neuss, Germany

[21] Appl. No.: 502,820

[22] Filed: Jul. 14, 1995

[30] Foreign Application Priority Data

Jul. 16, 1994 [DE] Germany ..... 44 25 293.5

[51] Int. Cl.[6] ..... F04C 18/344; F04C 27/00; F04C 29/02

[52] U.S. Cl. ..... 418/94; 418/147; 418/255; 418/270

[58] Field of Search ..... 418/147, 255, 418/91, 94, 270

[56] References Cited

U.S. PATENT DOCUMENTS

| | | | |
|---|---|---|---|
| 813,024 | 2/1906 | Renner | 418/255 |
| 902,501 | 10/1908 | Machlet | 418/255 |
| 1,339,347 | 5/1920 | Jackson | 418/147 |
| 4,144,005 | 3/1979 | Brucken | 418/255 |

FOREIGN PATENT DOCUMENTS

| | | | |
|---|---|---|---|
| 3734573 | 4/1988 | Germany | 418/255 |
| 3813132 | 12/1988 | Germany . | |
| 4018509 | 1/1991 | Germany . | |
| 2328 | of 1868 | United Kingdom | 418/147 |
| 2382 | of 1879 | United Kingdom | 418/147 |

OTHER PUBLICATIONS

R. Plank & J. Kuprianoff: Rotary Compressors for Refrigeration, VDT Journal vol. 79, dated Mar. 23, 1935, pp. 369–372.

*Primary Examiner*—John J. Vrablik
*Attorney, Agent, or Firm*—Ladas & Parry

[57] ABSTRACT

A rotary piston pump in which a slide valve has a pivot bearing at each of its ends which supports a sliding block and wherein a theoretical slide valve length in the position in which the axes of symmetry of the shell rotor and slide valve are superimposed, is equal to the sum of the length along the slide valve measured between the pivot bearings plus two times the thickness of a sliding block measured between its pivot bearing and the wall of the shell. The sliding blocks have an outer surface with a curvature between the curvature of the outer surface of the rotor and the maximum curvature of the wall of the shell.

6 Claims, 3 Drawing Sheets

FIG. 5
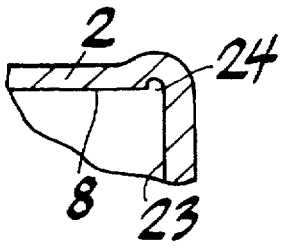
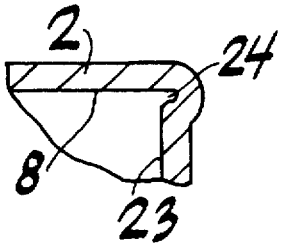
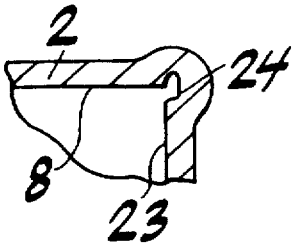
FIG. 4
FIG. 6
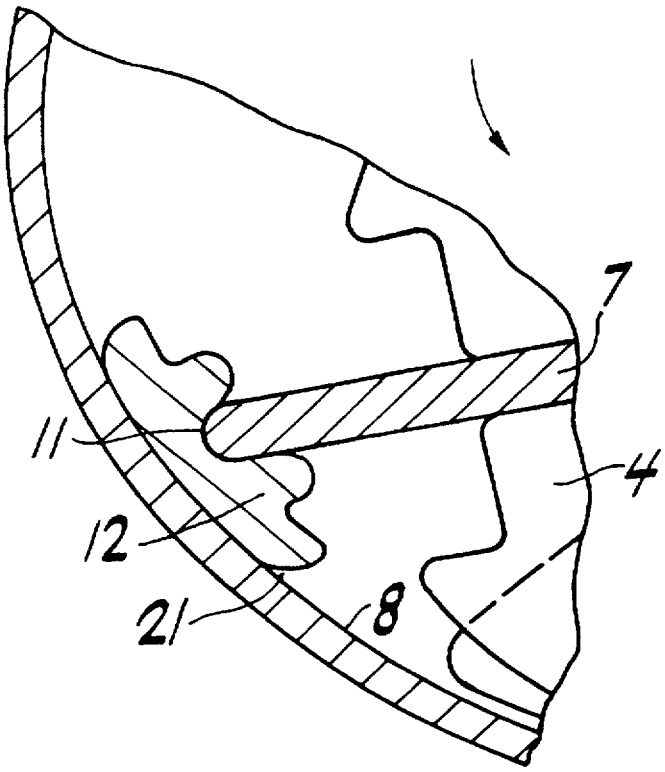
FIG. 7

ROTARY PISTON PUMP HAVING A SLIDE VALVE DRIVEN BY A ROTOR

FIELD OF THE INVENTION

The invention relates to a rotary piston pump and in particular to such a pump having a fixed length slide valve slidably mounted in a slot in a rotor which is rotatable in a cylinder shell having a non-circular cross section with a wall whose secants pass through the center of the rotation of the rotor and are substantially equal to the length of the slide valve measured between its end points in contact with the wall of the cylinder shell.

Such a rotary piston pump can be driven by an automobile engine and can pump a fluid, particularly air for producing a vacuum or compressed air, for automobile accessories.

BACKGROUND AND PRIOR ART

Such a pump is disclosed in DE-A1 40 18 509, in which a single slide valve is driven to slide in a guide slot of the rotor. The housing has a wall with a cross section that is circumscribed by a closed curve according to the instructions from R. Plank and J. Kuprianoff: Rotary Compressors for Refrigerators, VDI Journal Volume 79, dated Mar. 23, 1935, pp. 369 to 372 (Design Principles and Kinematic Analysis of a Rotary Piston Compressor With a Fixed-Length Driven Slide Valve).

By designing the cross section of the housing in the shape specified there as a Pascal spiral and by a pointed design of the ends of the slide valve, it is possible geometrically to construct a rotary piston compressor with only one slide valve.

A drawback to this compressor is that the housing and rotor are in contact linearly only at bottom dead center in which one end of the slide valve is completely inserted in a recess in the rotor. With such a short seal length, leakage occurs in this area between the compression and suction regions of the pump with a corresponding impairment of the volumetric efficiency.

For this reason, DE-A1 38 13 132 provides for the radius of curvature of the housing cross section in the seal area to be essentially the same as the radius of curvature of the rotor, in contrast to the Pascal spiral, so that the seal length is longer.

Now, however, the volumetric efficiency of such a compressor is also impaired by the short seal length between the slide valve and the cylinder wall, and this impairment is even doubled, since the slide valve has two points of contact with the cylinder wall.

Furthermore, the design in DE-A1 38 13 132 represents a compressor that is no longer adequate with regard to present standards for production.

SUMMARY OF THE INVENTION

It is therefore an object of this invention, proceeding from the known rotary piston pump, to provide an improvement thereof so that the volumetric efficiency is increased, and advantageous economical manufacture and long lifetime are achieved.

In accordance with the invention, a pivot bearing is provided at each end of the slide valve and a sliding block is pivotably connected to the pivot bearing at each end of the slide valve. Each sliding block is in contact with the wall surface of the shell and the theoretical blanks of the slide, which determines the cross-sectional shape of the wall surface of the shell, is equal to the distance between the pivot bearings at the ends of the slide valve plus two times the thickness of one of the sliding blocks measured between the pivot bearing thereof and the cylinder wall when the axes of symmetry of the rotor and the slide valve are superimposed. The theoretical slide valve length is substantially equal to the length of the secants defining the wall surface.

In further accordance with the invention, the sliding blocks have an outer surface which contacts the wall surface, said outer surface having a curvature between the curvature of the outer surface of the rotor and the maximum curvature of the wall surface.

BRIEF DESCRIPTION OF THE FIGURES OF THE DRAWING

FIGS. 4 to 6 illustrate modified embodiments of a detail of a portion of the housing of the pump as shown in FIG. 2.

FIG. 7 shows on enlarged scale a detail of a portion of FIG. 1.

DETAILED DESCRIPTION OF PREFERRED EMBODIMENTS

Figure 1:
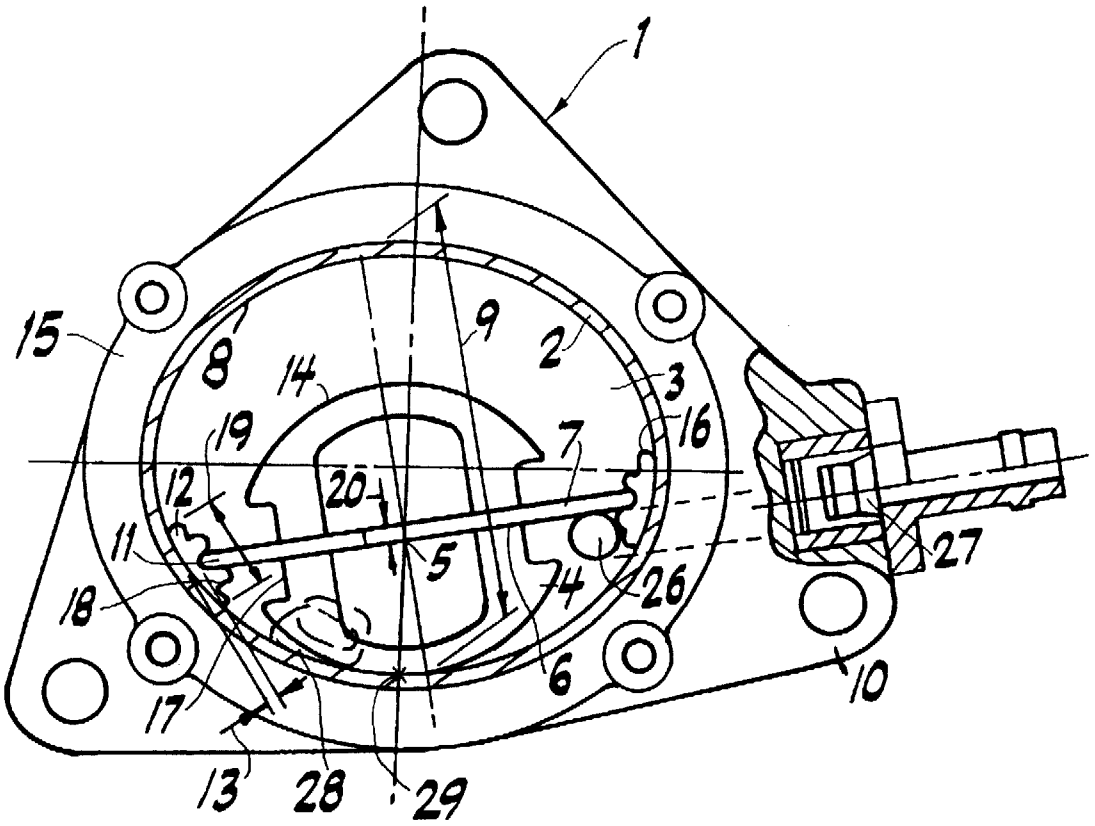
FIG. 1 is a cutaway end view of a rotary piston pump according to the invention.

FIG. 1 shows a rotary piston pump 1 having a hollow cylinder shell 2 containing a pump chamber 3 in which a rotor 4 is disposed for rotational movement about an axis of rotation 5, the rotor having a slot 6 extending through the center of rotation of the rotor in which a fixed length slide valve 7 is slidable and driven when the rotor rotates. The rotary piston pump 1 is intended to be driven by an automobile engine, for example, an in ternal combustion engine, to produce vacuum for automobile accessories.

The cylinder shell 2 has a non-circular cross-sectional surface characteristic of this type of pump, that is circumscribed by a curved wall surface 8 whose secants 9 passing through the center of rotation of the rotor 4 are essentially equal to the length of slide valve 1 between the points of contact of the slide valve 7 with the surface 8; the cylinder shell 2, a flange body 10, and the rotor 4 define the pump chamber 3, into which air enters at one end of the slide valve 7, and from which air is forced out at the other end of the slide valve 7. The pump 1 is connected to an oil-circulating system (not shown) which can be connected to the engine whose oil is transported by the air and lubricates and seals the pump.

The slide valve 7 has a pivot bearing 11 at each end which pivotably supports a sliding block 12; the theoretical slide valve length in the position in which the axes of symmetry of the cylinder, rotor, and slide valve are superimposed is the sum of the slide valve length measured between the pivot bearings 11 plus two times the thickness 13 of a sliding block 12 between its pivot bearing 11 and the cylinder wall 8.

The sliding blocks 12 have an outer surface with a curvature that is between the curvature of the outer surface 14 of the rotor 4 and the largest curvature of the surface of the cylinder shell 2.

The cylinder shell 2 is a one-piece body made as a deep-drawn press part having an integral flange collar 15 secured to the flange body 10 by bolts.

The length of the slide valve is advantageously between 0.01 and 1% less than the theoretical slide valve length so that there is a gap between the sliding block and the cylinder wall, and the curvature of the outer surface of the sliding block is made equal to or slightly larger than the largest curvature of the surface 8 of the cylinder wall. At its ends, the sliding block surface merges into a bevel or is rounded as shown at radius 16, so that the sliding block 12 is symmetrical and can be installed to travel left or right around the cylinder. Consequently, the pump 1 can be operated in both directions of rotation.

In each revolution of the rotor 4, the slide valve 7 with the sliding block 12 enters an end recess 17 provided in the outer surface of the rotor 4. The sliding block 12 has a face provided with recesses 18 at each end thereof which hold lubricating oil in the rotor recesses 17 when the face of the sliding block is fitted in the respective recess 17 driving periodic rotation of the rotor, in front of the sliding blocks 12, in the manner of an oil roller with the oil-circulating system connected.

As seen in FIG. 1, the sliding block 12 has a length 19 that is about three to five times the thickness 20 of the slide valve 7. In this way, the slide valve pivot bearing 11 can be machined directly out of the slide valve blank, in other words, the maximum possible diameter of the slide valve pivot bearing is then equal to the thickness of the slide valve. When the sliding block 12 pivots on the slide valve pivot bearing 11, with the point of contact drifting, the gap formed by the shortened length of the slide valve is changed to a convergent gap 21 (FIG. 7). This brings about a buildup of oil pressure and produces a film of lubricating oil between the sliding block and the cylinder surface with air being pumped and with oil lubrication.

Figure 2:
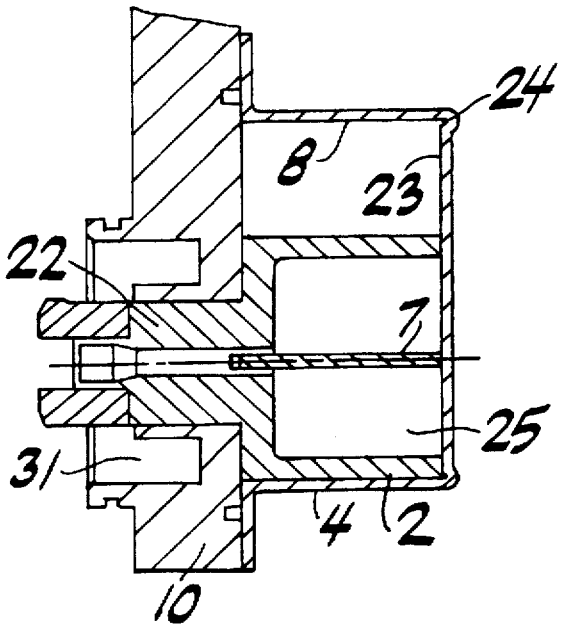
FIG. 2 is a longitudinal cross section through the pump of FIG. 1.

In FIG. 2 which shows a cross section through the pump 1, the flange body 10 supports a journal 22 of the rotor 4 for rotation. The cylinder shell 2 is provided with an outward bead 24 at the corner juncture of the cylinder wall 8 and an end face 23.

The bead 24 provides for advantageous manufacture and adequate strengthening of the cylinder shell 2. The rotor 4 is hollow and provided with a recess 25 that is closed off by the end face 23 of the shell 2 and recess 25 is connected to the oil-circulating system through a bore in the hollow bearing journal 22.

As shown in FIG. 1, the expanding pump chamber 3 has an inlet orifice 26 with a suction valve 27. A discharge orifice 28 is located in front of the dead center point 29 of the inward travel of the slide valve 7 and the discharge orifice 28 opens through a pressure valve 30 into a recess 31 in the flange body 10, which is open toward the engine.

Figure 3:
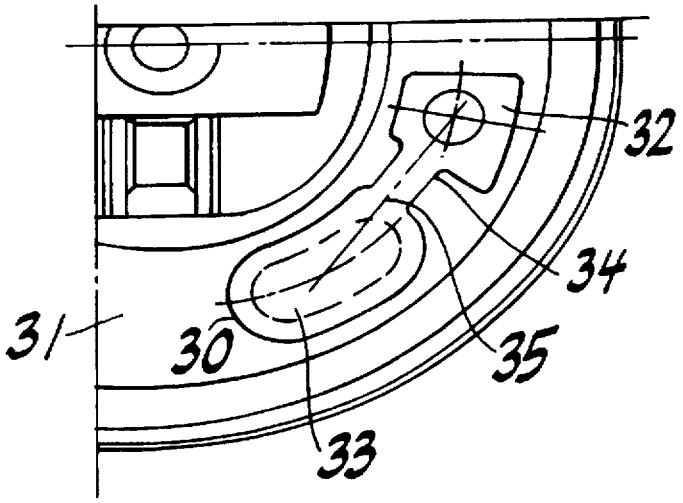
FIG. 3 is a view from the opposite end of FIG. 1 of a portion of the pump on enlarged scale.

The pressure valve 30 is advantageously constructed as a tongue valve 30 having a fastening portion 32 and a valve-closing portion 33 joined by a spring strip 34 integral therewith, whose center line 35 intersects the centers of gravity of the fastening and valve portions and is formed as a straight line as seen in FIG. 3. Consequently, the tongue valve 30 is loaded only in pure flexure, so that a long service life can be obtained.

Alternative embodiments of the bead 24 of FIGS. 1 and 2 are shown in FIGS. 4 to 6. FIG. 4 shows a construction in which the bead 24 extends diagonally upward, FIG. 5 to the right, and FIG. 6 downward.

FIG. 7 shows on enlarged scale the cylinder wall 8, the rotor 4, and the slide valve 7 with its pivot bearing 11 and sliding block 12. When the rotor 4 turns in the direction of the arrow, the convergent gap 21 is formed by pivoting on the pivot bearing 11 under the supporting force between he sliding block 12 and the pivot bearing 11, and between the sliding block 12 and the cylinder surface at the point of contact thereof.

The rotary piston pump of the invention has improved volumetric efficiency and lower wear, and is suitable for economical manufacture.

The illustrated pump 1 is adapted for emptying the vacuum tank (not shown) and pumping the air drawn from it into the engine with the lubricating oil through the recess 31. However, the pump 1 can also be operated as a compressor to produce compressed air, the discharge orifice 28 and the recess 31 then being connected to a compressed air tank and the inlet orifice 26 connected to the atmosphere. Unlubricated operation is also achievable with suitable provision of materials between the cylinder shell 2 and the sliding block 12.

The pump according to the invention is also suitable for pumping a liquid; the inlet and discharge orifices 25, 26 then are arranged appropriately for pumping with no internal compression.

Although the invention has been described in conjunction with specific embodiments thereof, it will become apparent to those skilled in the art that numerous modifications and variations can be made within the scope and spirit of the invention as defined in the attached claims.

What is claimed is:

1. In a rotary piston pump having a cylinder shell containing a rotor having a slot passing through a center of rotation of the rotor and in which a slide valve is driven as the rotor rotates, the shell having a wall with a surface of non-circular cross section whose secants pass through the center of rotation of the rotor and are substantially equal to a length of the slide valve between points of contact of the ends thereof with the wall surface, the improvement comprising:

a pivot bearing at each end of the slide valve, a sliding block pivotably connected to the pivot bearing at each end of the slide valve, each sliding block being in contact with the wall surface of the shell, a distance between the pivot bearings at the ends of the slide valve plus two times the thickness of one said sliding block between the pivot bearing thereof and the cylinder wall, when axes of symmetry of the rotor and the slide valve are superimposed, being a theoretical length defining the crosssectional shape of said wall and equal to the length of the secants defining the wall surface, said sliding blocks each having an outer surface which contacts the wall surface, said outer surface having a curvature between the curvature of the outer surface of the rotor and the maximum curvature of the wall surface, a flange body against which the cylinder shell is mounted, said cylinder shell comprising a one-piece deep drawn press part having an integral flange collar secured to said flange body, said cylindrical shell, flange body and rotor defining a pump chamber, said shell having a bead between said wall surface and an end face of the shell.

2. A rotary piston pump as claimed in claim 1, wherein said bead is formed at a corner between said wall surface and said end face of the shell and extends outwardly of said shell to provide reinforcement at said corner.

3. A rotary piston pump as claimed in claim 1, wherein said rotor is hollow and has an inner recess which is sealed by said end face of the shell and is connected to an oil circulating system through a bore provided in a bearing journal of the rotor in the flange body.

4. A rotary piston pump as claimed in claim 3, wherein said rotor has end recesses in which said sliding blocks are respectively received during rotation of the rotor, said sliding blocks each having a face with a recess which forms a chamber in the respective end recess of the rotor when the face of the sliding block is fitted in said end recess to hold lubricating oil in said end recess in the rotor.

5. A rotary piston pump as claimed in claim 1, wherein said shell is provided with an inlet orifice which opens into said pumping chamber and with a discharge orifice located in front of a dead center point of inward excursion of the slide valve and opens through a pressure valve into a recess provided in the flange body which is open toward the engine.

6. A rotary piston pump as claimed in claim 5, wherein said pressure valve comprises a curved tongue valve having a fastening portion and a valve-closing portion extending circumferentially along the recess in the flange body and joined by a straight spring strip integral therewith, said spring strip having a straight center line which passes through centers of the fastening and valve portions.

* * * * *